US010065231B2

(12) United States Patent
Hollingworth et al.

(10) Patent No.: US 10,065,231 B2
(45) Date of Patent: Sep. 4, 2018

(54) SEATED END PROCESS

(71) Applicants: CROWN PACKAGING TECHNOLOGY INC, Alsip, IL (US); Michael Bonsall, Mansfield (GB); David Hollingworth, Mansfield (GB)

(72) Inventors: David Malcolm Hollingworth, Nottinghamshire (GB); Michael George Bonsall, Nottinghamshire (GB)

(73) Assignee: Crown Packaging Technology, Inc., Alsip, IL (US)

( * ) Notice: Subject to any disclaimer, the term of this patent is extended or adjusted under 35 U.S.C. 154(b) by 286 days.

(21) Appl. No.: 14/765,926

(22) PCT Filed: Dec. 6, 2013

(86) PCT No.: PCT/EP2013/075773
§ 371 (c)(1),
(2) Date: Aug. 5, 2015

(87) PCT Pub. No.: WO2014/121864
PCT Pub. Date: Aug. 14, 2014

(65) Prior Publication Data

US 2016/0001347 A1 Jan. 7, 2016

(30) Foreign Application Priority Data

Feb. 11, 2013 (GB) ..... 1302372.6

(51) Int. Cl.
*B21D 51/34* (2006.01)

(52) U.S. Cl.
CPC ..... *B21D 51/34* (2013.01)

(58) Field of Classification Search
CPC ..... B21D 51/30; B21D 51/32; B21D 51/34
See application file for complete search history.

(56) References Cited

U.S. PATENT DOCUMENTS

| | | | | |
|---|---|---|---|---|
| 995,953 A | | 6/1911 | Comings | |
| 3,385,249 A | * | 5/1968 | Czarnecki | B21D 51/2615 413/6 |
| 5,054,637 A | | 10/1991 | La Rovere | |

FOREIGN PATENT DOCUMENTS

| | | | |
|---|---|---|---|
| GB | 173610 | A | 1/1922 |
| GB | 507616 | A | 6/1939 |
| GB | 2166410 | A | 5/1986 |
| JP | S51-10476 | U1 | 1/1976 |
| JP | H01167050 | A | 6/1989 |
| JP | H0455028 | A | 2/1992 |
| JP | 08-048331 | A | 2/1996 |

* cited by examiner

*Primary Examiner* — Debra Sullivan
(74) *Attorney, Agent, or Firm* — Baker & Hostetler LLP

(57) ABSTRACT

A method of attaching a metal end (7) to a metal container body (6) in order to close an opening in the body, wherein the body (6) has a curled lip at least partially surrounding the opening and the end (7) has an upstanding lip extending at least partially around a periphery thereof. The method comprises locating the end (7) within the body (6) at or near said opening, bringing a curling tool (8) into contact with said upstanding lip of the end (7) and applying a force to that lip, via the curling tool (8), in order to curl the upstanding lip around the curled lip of the body (6) to form interlocking curls.

14 Claims, 5 Drawing Sheets

SEATED END PROCESS

CROSS-REFERENCE TO RELATED APPLICATIONS

This application is the National Stage of International Application No. PCT/EP2013/075773, filed Dec. 6, 2013, which claims the benefit of Great Britain application number 1302372.6, filed Feb. 11, 2013, the disclosures of which are incorporated herein by reference in their entirety.

TECHNICAL FIELD

The present invention relates to a seated end process and in particular to such a process used to attach an end to a body of a container.

BACKGROUND

The process of attaching an end to a body of a metal container is well known in the art and conventionally involves a double seaming process. A double seam is formed by mechanically folding the periphery of the end over a flange of the body to interlock five layers of material together: three layers of the end and two layers of the body. The resulting double seam gives rise to a bulge around the rim of the container.

Before the double seaming process was available, ends were attached to the body of a metal container by soldering. Soldering of containers caused a variety of issues, including foreign contaminants such as lead and other harmful heavy metals. Although the double seaming process is a cheaper and safer alternative to soldering, the bulging double seam is not aesthetically desirable. Moreover, the bulging double seam around the rim of a container is often associated with cheap canned goods. This is a particular concern when the containers are used for decorative purposes for high end products.

A process of attaching an end to a container without using the double seam process is known in the art. FIG. 1 illustrates this process for attaching an end 1 to a body 2 of a metal container to provide a container with a "hidden" seam. The process involves inserting a lip 3 of the end 1 into a partially curled lip 4 of the body 2 to close an opening of the body. Once in position, a curling tool is applied against the partially curled lip 4 of the body, whilst pressing down on the end 1 with a substantially flat reaction tool, to further curl it securely around the lip 3 of the end 1. The process results in clasped lips 5, which attach the end to the body. The definitions of a curling tool and a reaction tool are described in the detailed description below.

In order to form a tight closure, the perimeter of the end 1 must be a tight fit around the inside of the body 2. As such, the end 1 can only be inserted into the body 2 by tilting the end at an angle relative to the body. Subsequent levelling of the end 1 may cause scratching of the internal lacquer.

Thus, it is desirable to provide a process of attaching an end to a body of a container that does not damage the inside of the body, and that produces a "hidden" seam. It is also preferable that the process can be readily automated.

SUMMARY

Surprisingly, it has been found that by manipulating the shape of an end around a body of a container, it is possible to attach the end to the body using a "hidden" seam and without causing damage to the inside of the body. Moreover, this process was found to be amenable to automation.

According to an aspect of the present invention there is provided a method of attaching a metal end to a metal container body in order to close an opening in the body, wherein the body has a curled lip at least partially surrounding the opening. The method comprises locating the end within the body at or near said opening such that said upstanding lip projects inwardly, from the end, with respect to the can body, and bringing a curling tool through the can body into contact with a lip extending at least partially around a periphery of said end in order to curl the lip around the curled lip of the body. This method may be readily automated.

In a possible embodiment, a reaction tool is used to counteract a force applied by the curling tool. In another embodiment, a reaction tool and a further reaction are used to counteract the force applied by the curling tool on the end and the curled lip of the body respectively. In yet a further embodiment, the diameter or other transverse dimension of the end is increased during the process.

In still a further embodiment, the end is introduced into the body via a second opening, substantially opposed to the first mentioned opening.

In a further embodiment the end and the body are made from metal, preferably aluminium or steel.

DETAILED DESCRIPTION

Figure 1:
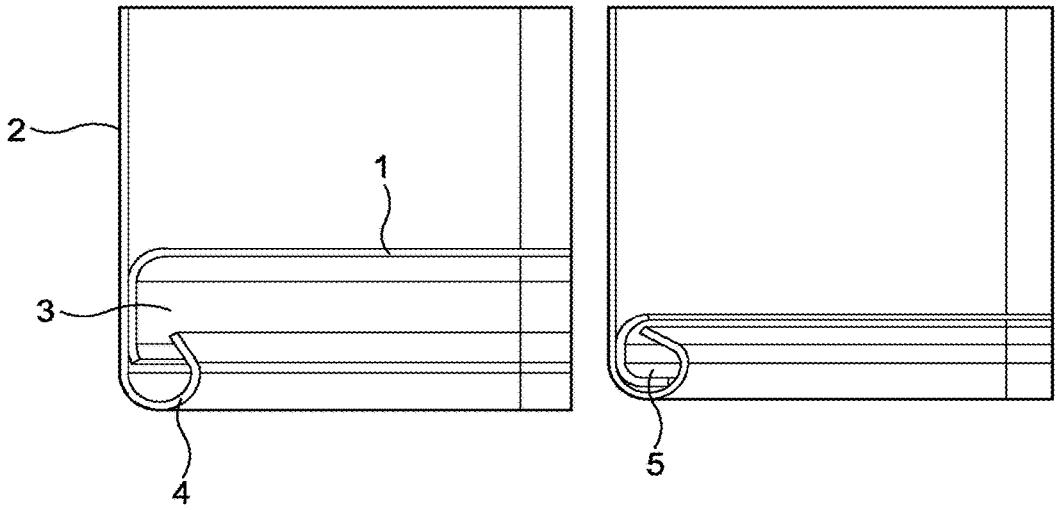
Figure 1 (Prior Art)
FIG. 1 illustrates schematically a process for the attachment of an end to a body of a container as known in the art.
Figure 2:
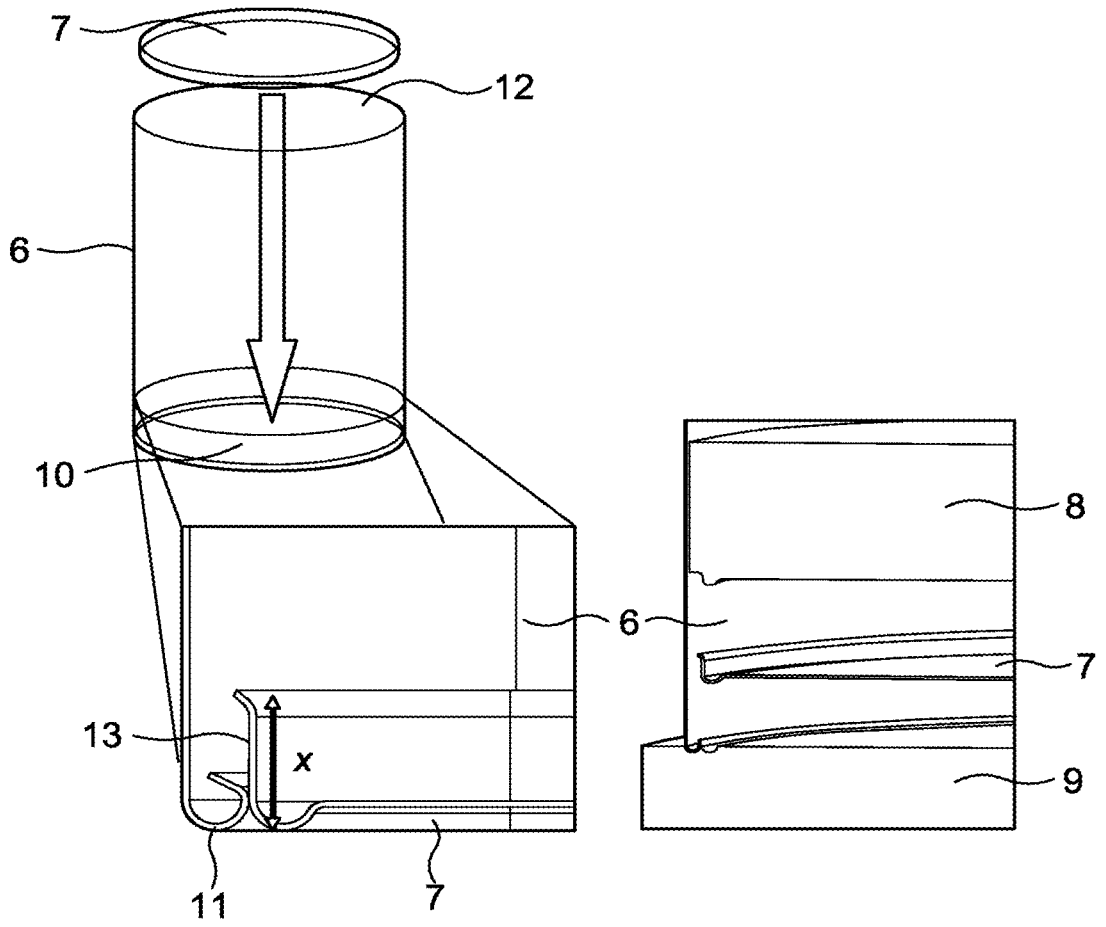
FIG. 2 illustrates schematically an improved process for attaching an end to a body.

A known process for attaching an end to a contained body so as to produce a hidden seam has been described with reference to FIG. 1. Referring now to FIG. 2, an improved and potentially automatable process will be described. FIG. 2 illustrates a cylindrical body 6 of a metal container, a generally circular end 7, a curling tool 8 and a reaction tool 9. The body 6 has a first lower and generally circular opening 10. An edge surrounding the opening 10 of the body 6 is curled inwardly to form a curled lip 11, extending at least part way around its periphery. The body has a second upper and generally circular opening 12, opposite the lower opening 10. The outside surface of the body may have a decorative finish whilst the inside may have a plain lacquer finish.

The end 7 has a raised boundary, extending at least part way around its periphery, to form a lip 13. The height of the lip, indicated as x in FIG. 2, must be such that there is enough material to curl the lip 13 around the curled lip 11 of the body as will be described. It is preferable that the lip 13 has a slight bend in the direction it will be curled. The shape of the end will be complimentary to the shape of the opening 10 of the body 6, i.e. circular in this case. It is preferred that the space between the perimeter of the end 7 and the inside of the body 6 is between 1.5-2 mm, depending on the shape of the body, to allow the end 7 to be positioned at or near the opening 10 of the body 6 in an automated manner, without damaging the lacquer on the inside of the body 6. As indicated by the arrow in FIG. 2, the end 7 is inserted into the body through the upper opening 12, and then lowered through the body until it is located adjacent to the lower opening 10. The upper opening may be subsequently closed using methods commonly known in the art, including a detachable lid or a breakable seal or both.

The body 6 of a container and the end 7 may be made of any malleable material, such as metal, preferably aluminium or steel.

The curling tool 8 is a tool used to manipulate the shape of a malleable material, preferably metal, into a curl. The shape of the resulting curl is complementary to an arc of the curling tool 8. The perimeter of the curling tool should be slightly larger than the perimeter of the end 7, but small enough so that it can pass freely within the body 6 without damaging the lacquer. Aside from the curling arc, the shapes of the surfaces of the curling tool 8 and the end 7, which come in contact, are complementary to each other.

The reaction tool 9 holds the body 6 and the end 7 in position. To do this, the reaction tool is shaped to complement the exterior shape of the base of the container, that is the base formed when the end 7 is positioned within the body 6 to close off the opening 10. The reaction tool also counteracts the force applied by the curling tool 8. It is preferable that the perimeter of the reaction tool 9 is larger than the perimeter of the body 6.

The curling tool and the reaction tool may be made of any material capable of exerting and counteracting, respectively, enough force to mould the end 7 into a desired shape. It is preferable that the curling and reaction tools are made from some toughened metal.

Figure 3:
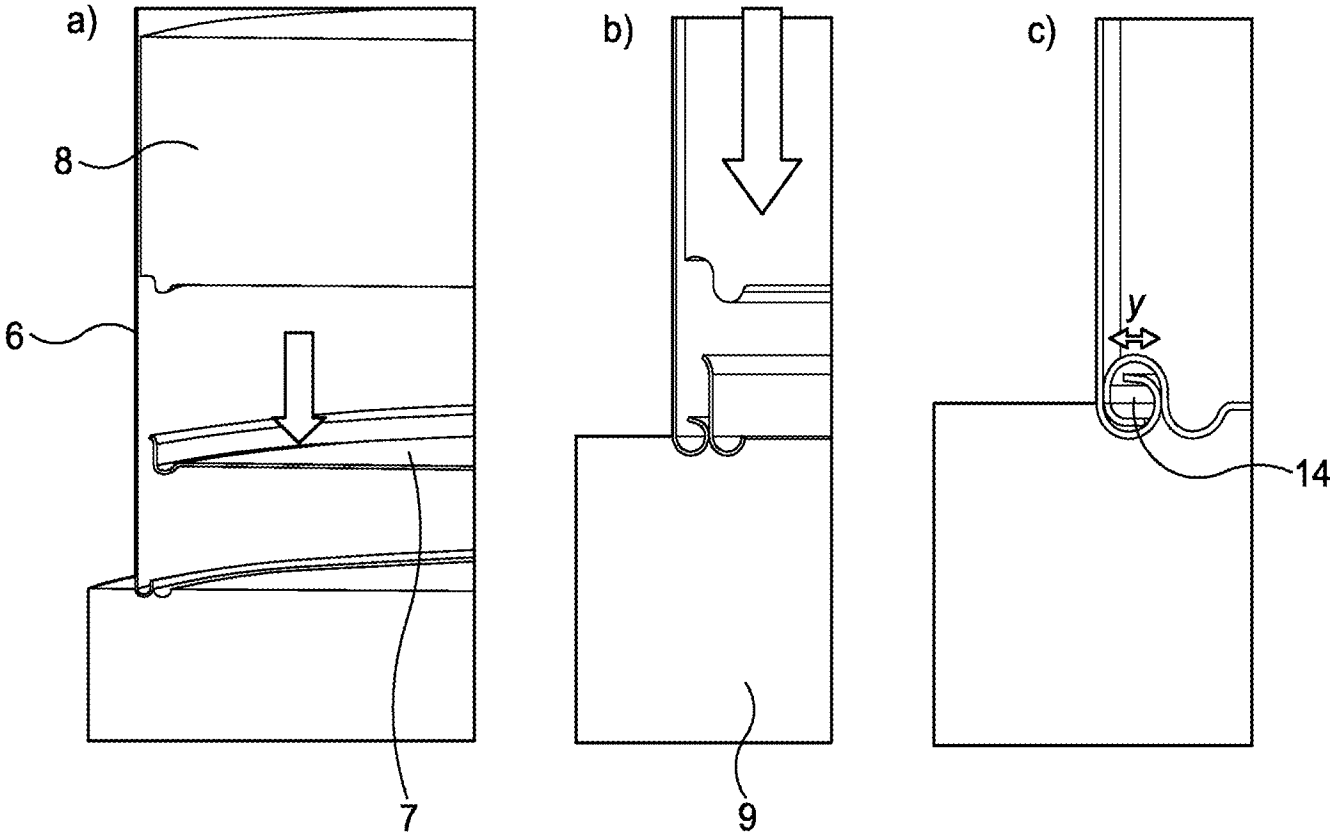
FIG. 3 further illustrates the improved process of FIG. 2.

The steps of the improved process will now be described with reference to FIG. 3.

The end 7 is placed within the body 6 to close off the opening 10 (step a). [This may be achieved by initially affixing the end 7 to the lower surface of the curling tool 8 and moving the curling tool through the container body. The end 7 may also be positioned to close off the opening 10 independently of the curling tool 8.] The end 7 is inserted into the body 6 through the second upper opening 12. The end 7 is positioned relative to the body 6 such that the lip 13 of the end is adjacent to the curled lip 11 of the body. The end 7 is held in position relative to the body 6 by the reaction tool 9.

Once the end 7 is in position relative to the body 6, the curling tool 8 is applied to the lip 13 (step b). As opposing forces are exerted by the curling tool 8 and the reaction tool 9, the lip 13 of the end 7 is curled around the curled lip 11 of the body 6 such that clasped lips 14 are formed to securely attach the end 7 around the body 6 (step c) with a "hidden" seam.

The outer diameter of the end 7 is increased during the process compared to its starting dimension, as the lip 13 is curled laterally around the curled lip 11 of the body 6. A typical increase is indicated by range y in FIG. 3.

Figure 4:
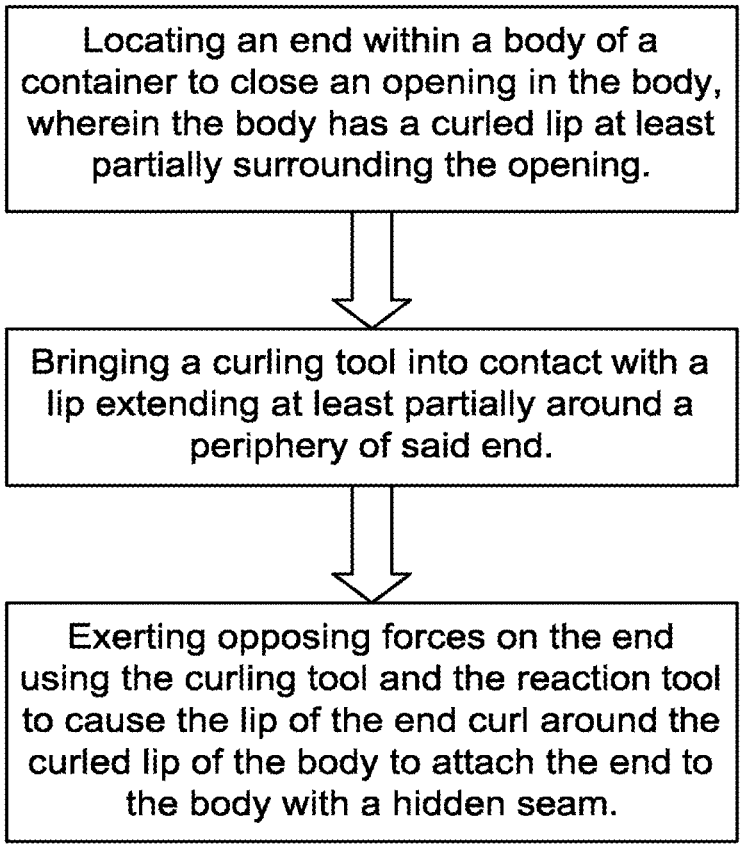
FIG. 4 is a flow diagram further illustrating the process of FIGS. 2 and 3.

The improved process described above is summarised in the flow diagram of FIG. 4.

By manipulating the shape of the end 7 as opposed to the body 6 of the container (although some change in the shape of the lip 11 may also occur), it is not necessary for the perimeter of the end 7 to be a tight fit around the inside of the body of the container. Consequently, the process may be automated without damaging the lacquer on the inside of the body 6 of the container.

Therefore, the process provides a way of attaching an end to a body of a container that results in a "hidden" seam. This process can be readily automated.

It will be appreciated by the person of skill in the art that various modifications may be made to the above described embodiments without departing from the scope of the present invention. For example, whilst the process has been described in the context of a circular cylindrical container, it may also be applied to other shapes including those having a square or rectangular cross-section.

An alternative exemplary process to that described above will now be described with reference to FIG. 5.

Figure 5:
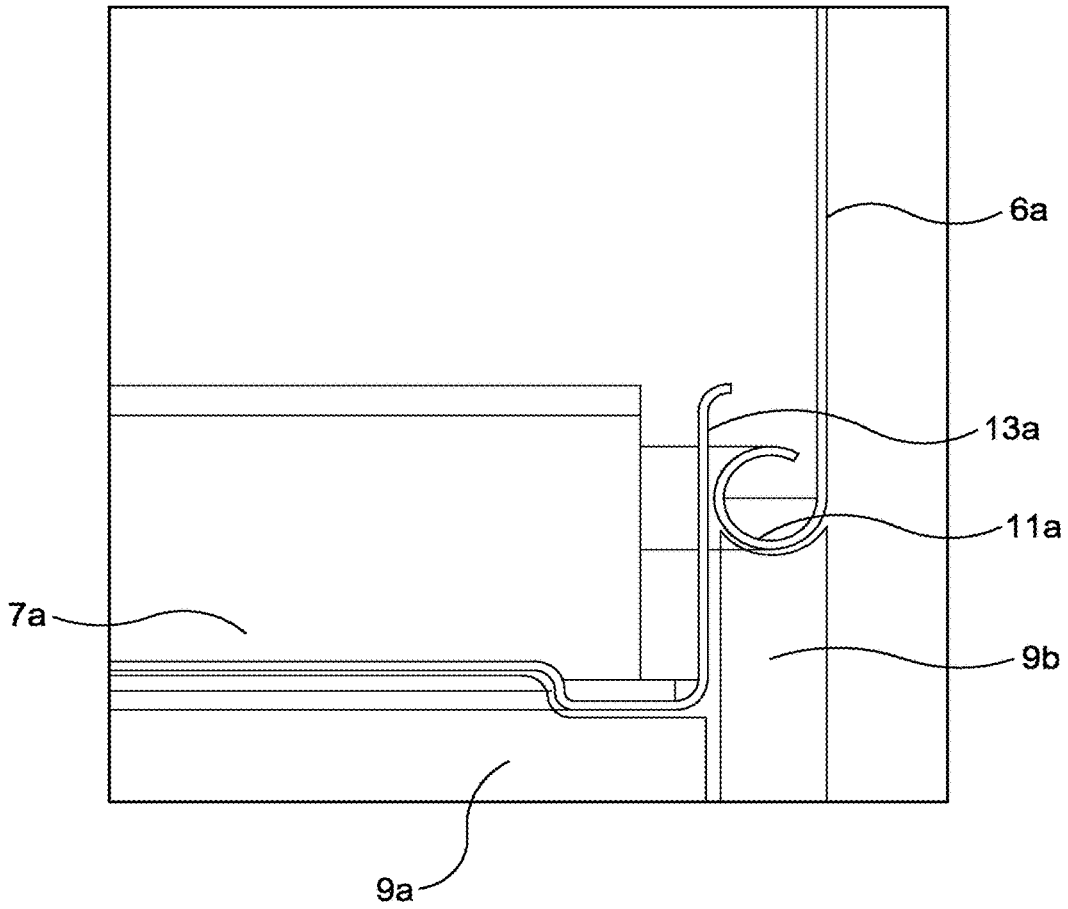
FIG. 5 illustrates schematically an alternative exemplary process to that illustrated in FIGS. 2 and 3.

FIG. 5 illustrates a substantially square or rectangular end 7*a* placed within an opening of a body 6*a* of a corresponding square or rectangular container. Specific features found therein which correspond to the components of the improved process described above with reference to FIGS. 2 and 3 will not be described again, but are applicable to the alternative exemplary process below.

In the alternative exemplary process, the end 7*a* and the body 6*a* are held in position relative to each other by two separate reaction tools 9*a* and 9*b* respectively. The reaction tool 9*a* supporting the end 7*a* has substantially the same perimeter as the end 7*a*. Its surface, which is in contact with the end 7*a*, is shaped to complement the base of the end. Reaction tool 9*a* is fixed in position.

The body 6*a* is held in position by a further reaction tool 9*b*. The further reaction tool 9*b* supports a base of the body, having a curled lip 11*a* surrounding an opening of the body 6*a*. The further reaction tool 9*b* extends at least part way around the periphery of the reaction tool. The further reaction tool 9*b* is adapted to move axially, and its movement is independent of the reaction tool 9*a*, using methods commonly known in the art including a spring loaded mechanism.

In the alternative exemplary process, the end 7*a* is positioned to close off an opening of the body 6*a* such that the curled lip 11*a* of the body 6*a* is adjacent to the upper periphery of the lip 13*a* of the end. The end 7*a* is held in position relative to the body 6*a* by the two reaction tools 9*a*, 9*b*. Once the end 7*a* is in position, a curling tool is applied to the lip 13*a* as before in the improved process. As opposing forces are exerted by the curling tool and the reaction tool 9*a*, the lip 13*a* of the end 7*a* is curled around the curled lip 11*a* of the body 6*a* such that clasped lips are formed to securely attach the end 7*a* around the body 6*a* with a "hidden seam". As a result of the curling step, the further reaction tool 9*b* is lowered axially, such that, at the end of the curling step, the base of the end 7*a* is located substantially at the base of the body 6*a*.

By positioning the curled lip 11*a* of the body 6*a* adjacent to the upper periphery of the lip 13*a* of the end 7*a* at the start of the curling step, it is possible to overcome the problem of curling the lip 13*a* outside of the curled lip 11*a* of the body 6*a*.

Whilst the modified process has been described in the context of a rectangular or square container, one skilled in the art would appreciate that the modified process may also be applied to other shapes including those having a circular cross section.

The invention claimed is:

1. A method of attaching a metal end to a metal container body in order to close an opening in the body, wherein the body has a curled lip at least partially surrounding the opening and the metal end has an upstanding lip extending at least partially around a periphery thereof, the method comprising the steps of:

locating the metal end within the body at or near said opening such that said upstanding lip projects inwardly, from the periphery of the metal end, in a direction into the container body;

bringing a curling tool through the container body into contact with said upstanding lip of the metal end; and applying a force to said upstanding lip, via the curling tool, in order to curl the upstanding lip around the curled lip of the body to form interlocking curls within the container body.

2. A method according to claim 1, the method being such that the shape of said curled lip of the body is substantially unchanged during the step of applying a force.

3. A method according to claim 1, further comprising the step of positioning a reaction tool in contact with the metal end and with said curled lip of the body in order to counteract the force applied by the curling tool during the step of applying a force.

4. A method according to claim 3, wherein said reaction tool has an upper surface that is complimentary in shape to lower engagement surfaces of the body and the metal end.

5. A method according to claim 1, further comprising positioning a first reaction tool in contact with the metal end and a second reaction tool in contact with said curled lip of the body, in order to counteract the force applied by the curling tool.

6. A method according to claim 5, wherein the first reaction tool and the second reaction tool move axially in relation to and independently of each other.

7. A method according to claim 1, wherein a transverse dimension of the metal end is increased as a result of the curling.

8. A method according to claim 1, wherein the metal end and the body are of steel or aluminium.

9. A method according to claim 1, wherein the opening is a first opening, the method further comprising introducing the curling tool into the body via a second opening in the container body.

10. A method according to claim 1, wherein the curled lip is curled inwardly toward a centre of the body.

11. A method of attaching a metal end to a metal container body in order to close an opening in the body, wherein the body has a curled lip at least partially surrounding the opening and the metal end has an upstanding lip extending at least partially around a periphery thereof, the method comprising the steps of:

locating the metal end within the body at or near said opening such that said upstanding lip projects inwardly, from the metal end, into the container body;

bringing a curling tool through the container body into contact with said upstanding lip of the metal end; and applying a force to said upstanding lip, via the curling tool, in order to curl the upstanding lip around the curled lip of the body to form interlocking curls within the container body, wherein said curling tool has a curling surface for engaging said upstanding lip such that during said step of applying a force said upstanding lip flows initially in an outward direction, relative to centre of the body.

12. A method according to claim 11, wherein said step of applying a force to the upstanding lip results in the periphery of the upstanding lip flowing in an inward direction relative to the centre of the container body subsequent to said upstanding lip initially flowing in the outward direction.

13. A method of attaching a metal end to a metal container body in order to close a first opening in the body, wherein the body has a curled lip at least partially surrounding the opening and the metal end has an upstanding lip extending at least partially around a periphery thereof, the method comprising the steps of:

introducing the metal end into the body via a second opening in the body;

locating the metal end within the body at or near said first opening such that said upstanding lip projects inwardly, from the periphery of the metal end, in a direction into the container body;

bringing a curling tool through the container body into contact with said upstanding lip of the metal end; and applying a force to said upstanding lip, via the curling tool, in order to curl the upstanding lip around the curled lip of the body to form interlocking curls.

14. A method according to claim 13, wherein said step of introducing the metal end is an automated process.

* * * * *